US007856672B1

(12) United States Patent
Koehler

(10) Patent No.: US 7,856,672 B1
(45) Date of Patent: Dec. 28, 2010

(54) BELT SWORD SYSTEM

(76) Inventor: Curtis W. Koehler, 4729 N. 70th St., Milwaukee, WI (US) 53218

( * ) Notice: Subject to any disclaimer, the term of this patent is extended or adjusted under 35 U.S.C. 154(b) by 1054 days.

(21) Appl. No.: 11/635,990

(22) Filed: Dec. 8, 2006

(51) Int. Cl.
*A41F 9/00* (2006.01)

(52) U.S. Cl. ..... 2/312

(58) Field of Classification Search ..... 2/338, 2/311, 312; 83/835–855; 451/526, 527, 451/529; D24/148; D8/20; 224/232, 233, 224/587, 600, 678; 30/151, 162, 123
See application file for complete search history.

(56) References Cited

U.S. PATENT DOCUMENTS

| | | | | | |
|---|---|---|---|---|---|
| 687,980 | A | * | 12/1901 | Duvall | 24/510 |
| 2,387,900 | A | * | 10/1945 | Hartwell | 224/197 |
| 3,823,421 | A | * | 7/1974 | Collins | 2/321 |
| 3,823,422 | A | * | 7/1974 | Forgett, Jr. | 2/321 |
| 4,100,655 | A | * | 7/1978 | Langley | 24/163 K |
| 4,203,167 | A | * | 5/1980 | Collins | 2/322 |
| 4,211,003 | A | * | 7/1980 | Collins | 30/162 |
| 4,313,230 | A | | 2/1982 | Chovaniec | 2/322 |
| D344,629 | S | * | 3/1994 | Steffek et al. | D3/226 |
| 5,367,714 | A | | 11/1994 | Hines et al. | 2/311 |
| 5,511,703 | A | * | 4/1996 | Ryerson | 224/682 |
| 6,067,661 | A | * | 5/2000 | Bates | 2/338 |
| 2003/0121946 | A1 | * | 7/2003 | Tai | 224/587 |
| 2004/0040164 | A1 | * | 3/2004 | Williams | 33/473 |

FOREIGN PATENT DOCUMENTS

DE 4033878 * 1/1992

OTHER PUBLICATIONS

"Leather Sword Hanger Frog." Reliks. Reliks, Inc. May 15, 2006. <http://www.reliks.com/merchant.ihtml?pid=1678>.*

* cited by examiner

*Primary Examiner*—Gary L Welch
*Assistant Examiner*—Amber R Anderson
(74) *Attorney, Agent, or Firm*—Donald J. Ersler

(57) ABSTRACT

A belt sword system includes a flexible sword and a sword belt. One end of the flexible sword includes a handle and the other end is angled to form a point. The handle may be formed by wrapping tape around the one end. At least one of the exposed lengthwise edges may be sharpened. The sword belt preferably includes a belt, a plurality of retention clips and a slide buckle keeper. The belt includes a strap and a retention buckle. The slide buckle keeper retains an end of the strap. The plurality of retention clips are attached along a length of the strap with rivets. The sword belt may be worn with the plurality of retention clips facing outward or facing inward toward the waist. Preferably, the flexible sword is inserted into the plurality of retention clips, before the sword belt is inserted into the loops of a pair of pants.

19 Claims, 7 Drawing Sheets

BELT SWORD SYSTEM

BACKGROUND OF THE INVENTION

1. Field of the Invention

The present invention relates generally to belts for retaining self-defense devices and more specifically to a belt sword system, which includes a belt structured to retain a flexible sword.

2. Discussion of the Prior Art

The need for self-defense devices is acute in many high crime areas. However, it is usually difficult for an ordinary citizen to obtain a firearm permit in high crime areas. U.S. Pat. No. 4,313,230 to Chovaniec discloses a belt for a concealed quick-draw knife. The Chovaniec patent includes a small weapon concealed in a belt for quick withdrawal. U.S. Pat. No. 5,367,714 to Hines et al. discloses a belt with concealed whip. The Hines et al. patent includes a belt, which conceals a whip in an internal sheath formed therein. The whip has a handle, which also is concealed by an end portion of the belt. The whip can be quickly and easily withdrawn from the sheath in the belt by releasing the end portion and grasping the handle.

However, a whip is round and incapable of being accelerated to high velocities. The whip is also not capable of inflicting serious injury. It is preferable to provide a self-defense device having greater mass and thus greater impact than a whip having a small width. It is also preferable to provide a self-defense device having a width that is at least three times the thickness thereof.

Accordingly, there is a clearly felt need in the art for a sword retaining belt, which includes a belt structured to retain a flexible sword and a flexible sword that may be sharpened along one or both of its lengthwise edges.

SUMMARY OF THE INVENTION

The present invention provides a belt sword system, which includes a belt structured to retain a flexible sword. The belt sword system includes a flexible sword and a sword belt. The flexible sword preferably includes a thin strip of metal. One end of the flexible sword includes a handle and the other end is preferably angled to form a point. The handle may be formed by wrapping tape, thin leather strips or nylon cord around the one end of the flexible sword, or the handle may be formed by dipping the one end in a plastic type coating. At least one of the exposed lengthwise edges and the other end may be modified to form a sharp edge or a razor sharp edge.

The sword belt preferably includes a belt, a plurality of retention clips and a slide buckle keeper. The belt includes a strap and a retention buckle. The strap includes a plurality of prong holes sized to receive a prong of the buckle. The slide buckle keeper retains an end of the strap. The plurality of retention clips are attached along a length of the strap with rivets or the like. When the sword is sharpened along the length, it is preferable to attach each retention clip as close as possible to prevent injury when wearing the sword belt. The sword belt may be worn with the plurality of retention clips facing outward from the waist or facing inward toward the waist.

The flexible sword is preferably inserted into the plurality of retention clips, before the sword belt is inserted through loops in a pair of pants as a normal belt. Once the sword belt is retained on the pair of pants, the one end of the flexible sword is positioned behind an end of the strap and the slide buckle keeper. The flexible sword may be withdrawn by sliding the slide buckle keeper away from an end of the handle and grasping the handle and pulling the flexible sword out of the sword belt.

Accordingly, it is an object of the present invention to provide a belt sword system, which includes a belt structured to retain a flexible sword.

Finally, it is another object of the present invention to provide a belt sword system, which includes a flexible sword that may be sharpened along one or both of the lengthwise edges.

These and additional objects, advantages, features and benefits of the present invention will become apparent from the following specification.

DETAILED DESCRIPTION OF THE PREFERRED EMBODIMENTS

Figure 1:
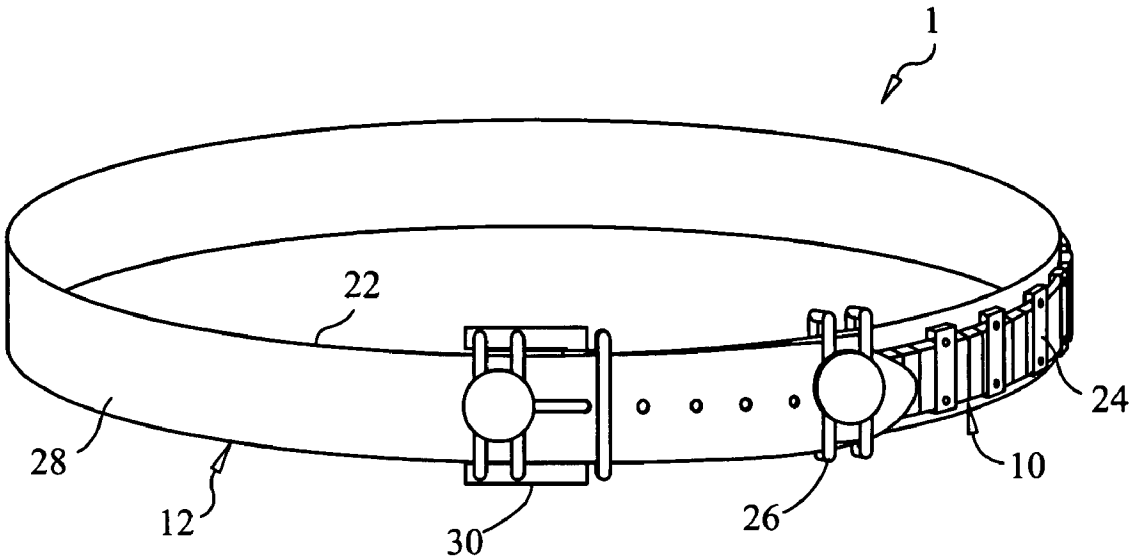
FIG. 1 is a perspective view of a belt sword system in accordance with the present invention.
Figure 2:
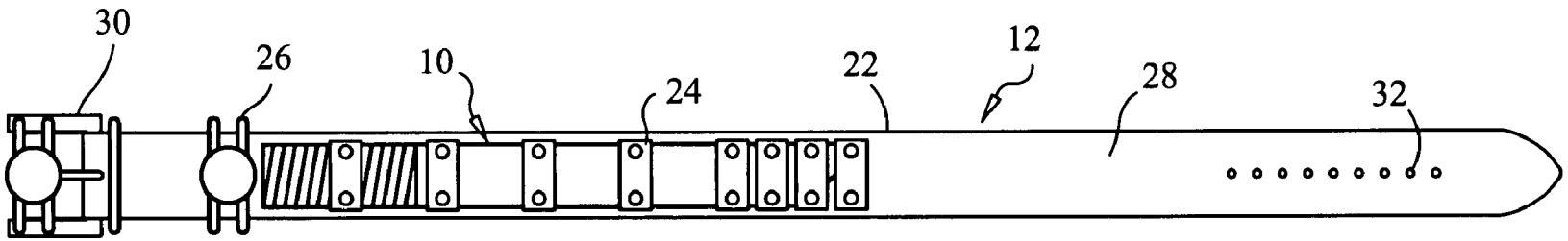
FIG. 2 is a front view of a belt sword system in accordance with the present invention.
Figure 3:
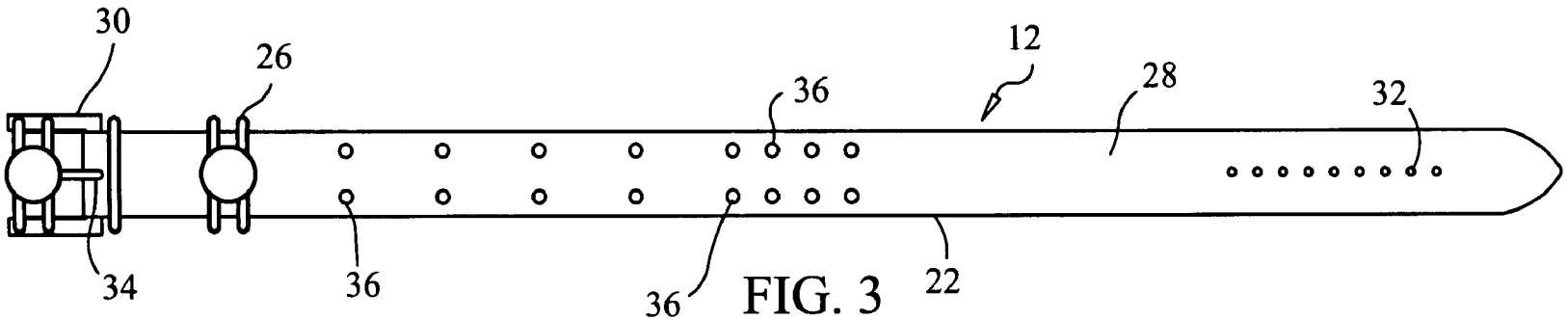
FIG. 3 is a rear view of a belt sword system in accordance with the present invention.
Figure 4:
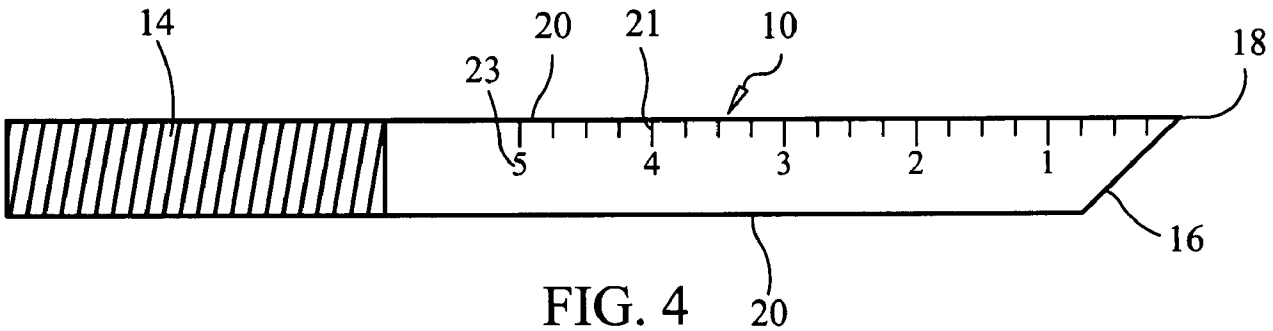
FIG. 4 is a front view of a flexible sword of a belt sword system in accordance with the present invention.
Figure 5:
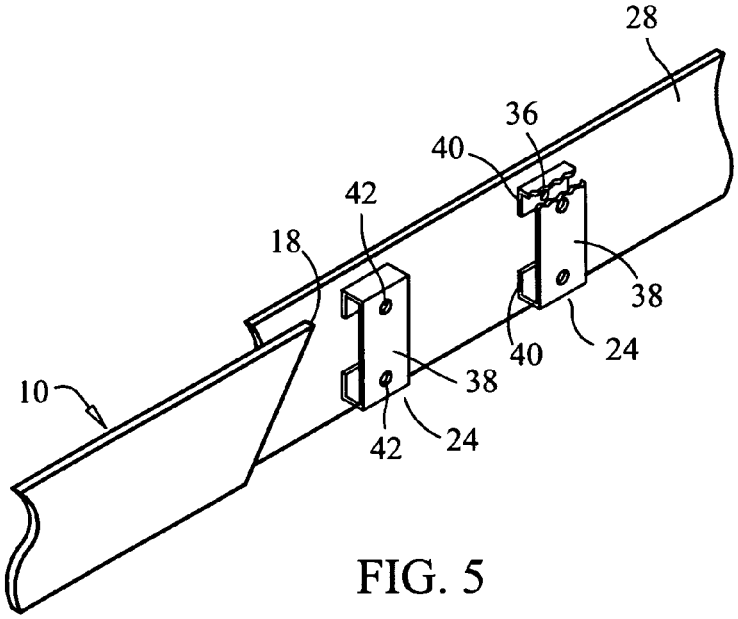
FIG. 5 is a perspective view of an end of a flexible sword adjacent a retention clip, before insertion of the flexible sword into a belt sword system in accordance with the present invention.
Figure 6:
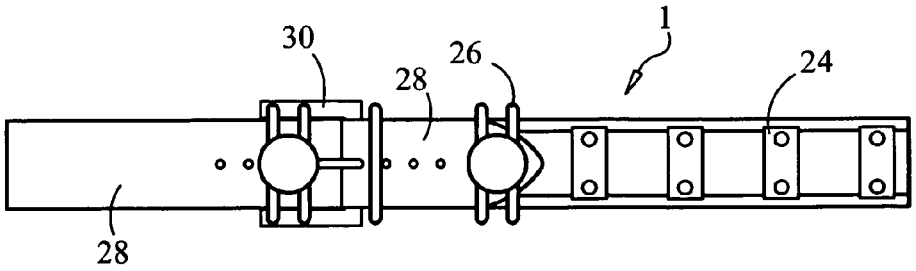
FIG. 6 is a front view of a belt sword system attached to itself in accordance with the present invention.
Figure 7:
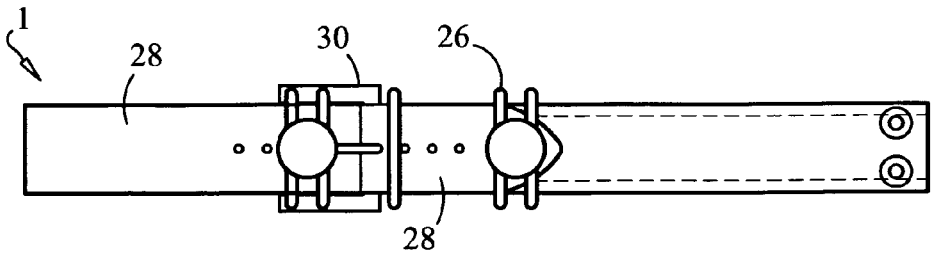
FIG. 7 is a front view of a reversed belt sword system attached to itself in accordance with the present invention.
Figure 8:
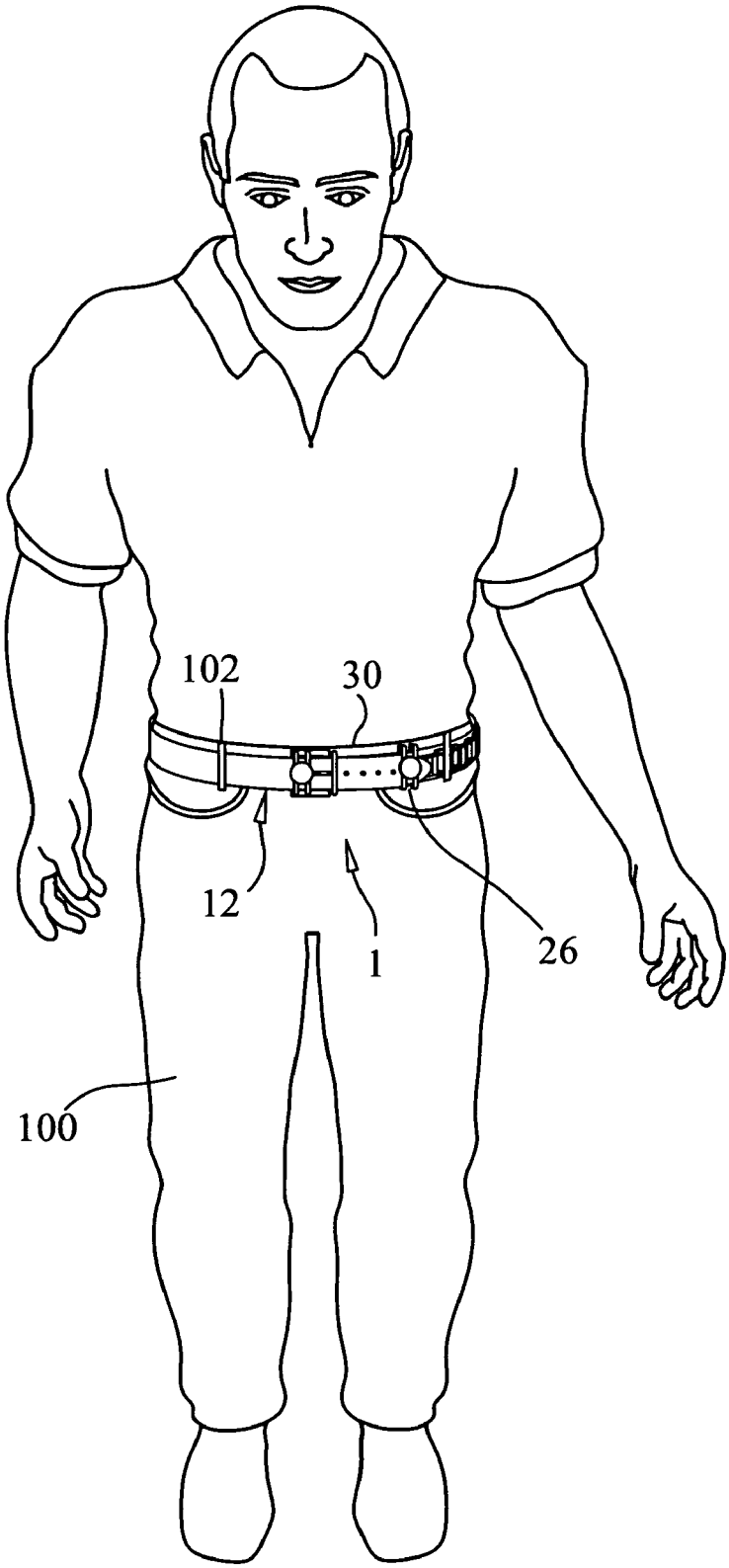
FIG. 8 is a perspective view of a belt sword system worn around a waist of a user in accordance with the present invention.
Figure 9:
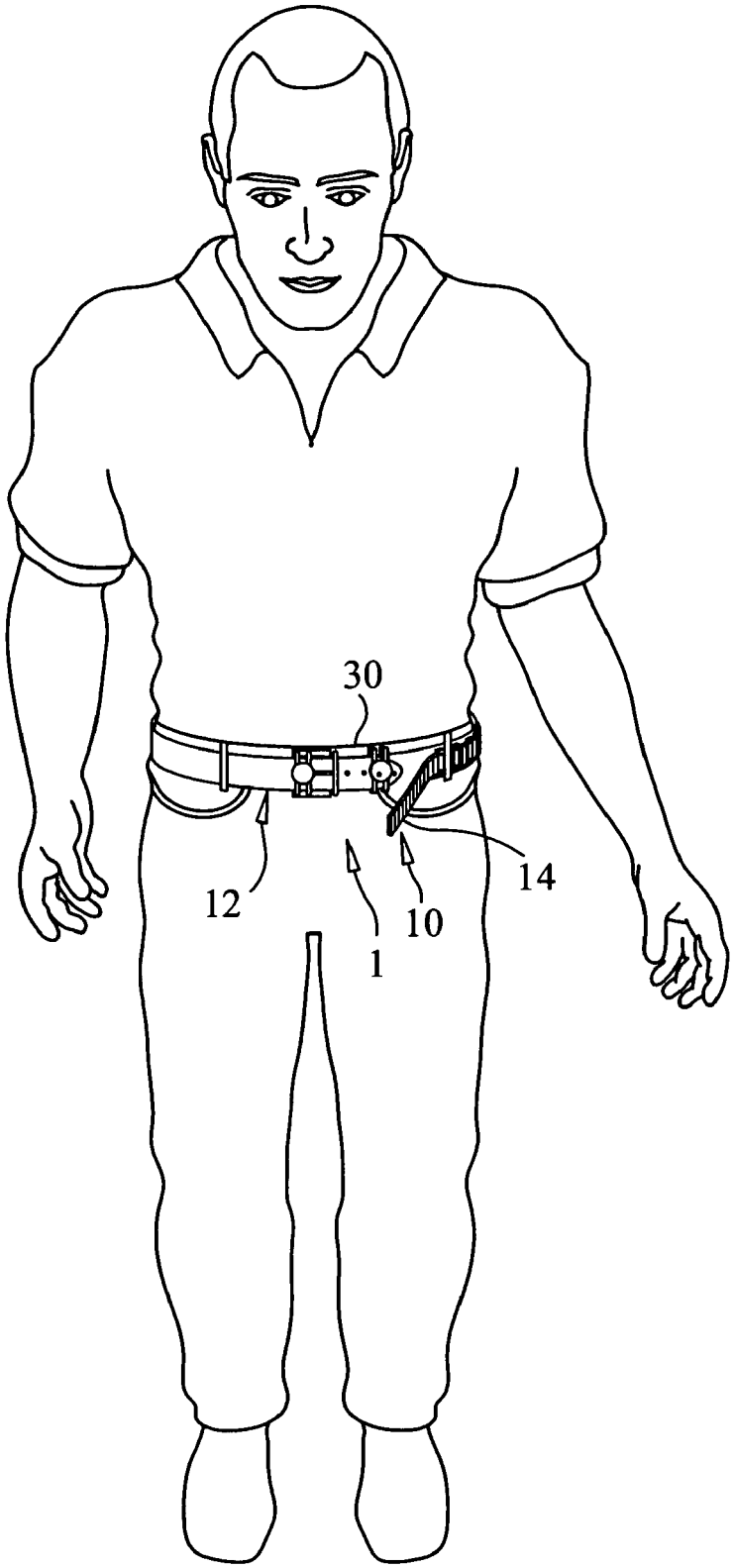
FIG. 9 is a perspective view of a belt sword system worn around a waist of a user and with a handle of a flexible sword ready to be grasped in accordance with the present invention.
Figure 10:
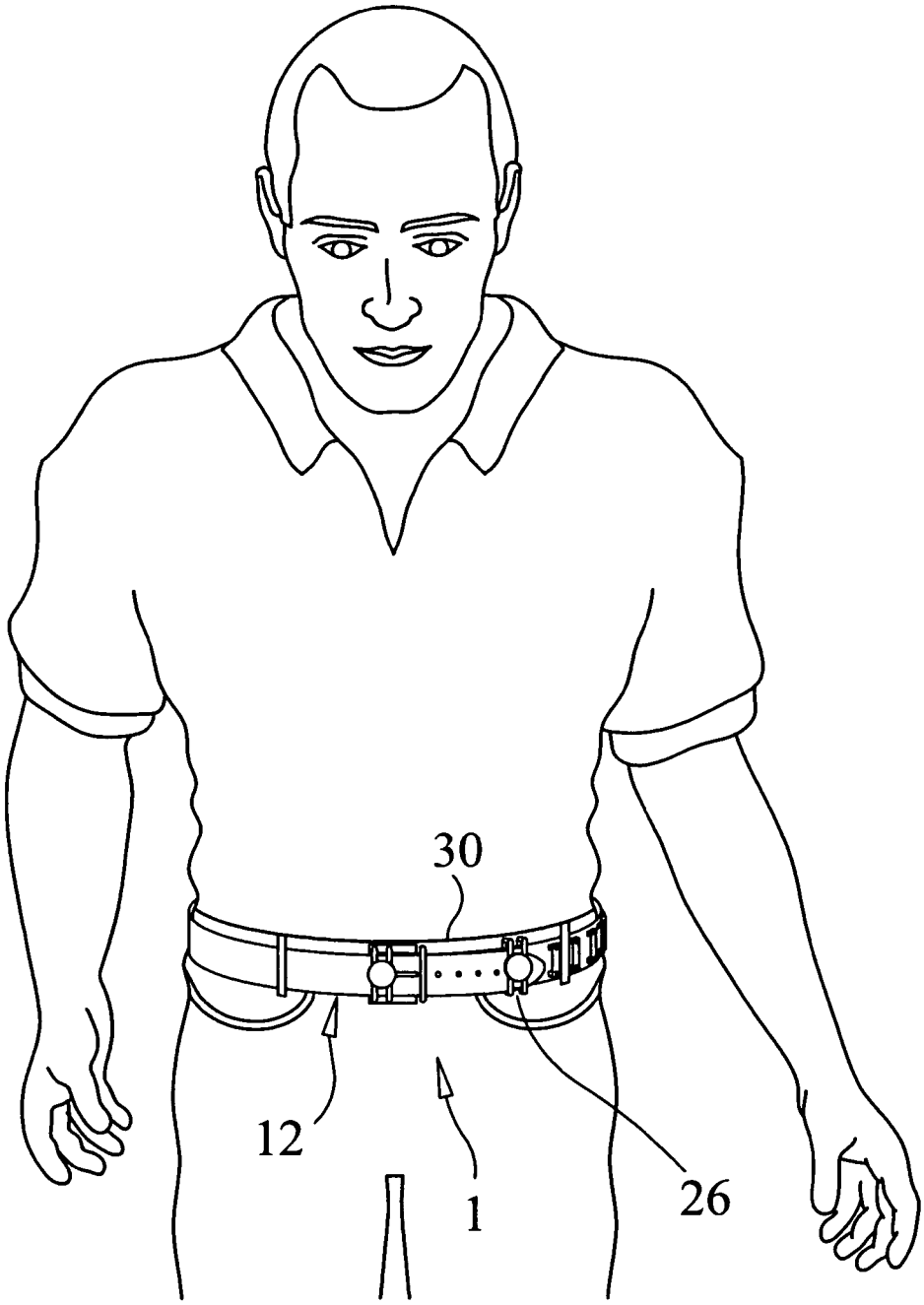
FIG. 10 is a perspective view of a reversed belt sword system worn around a waist of a user in accordance with the present invention.
Figure 11:
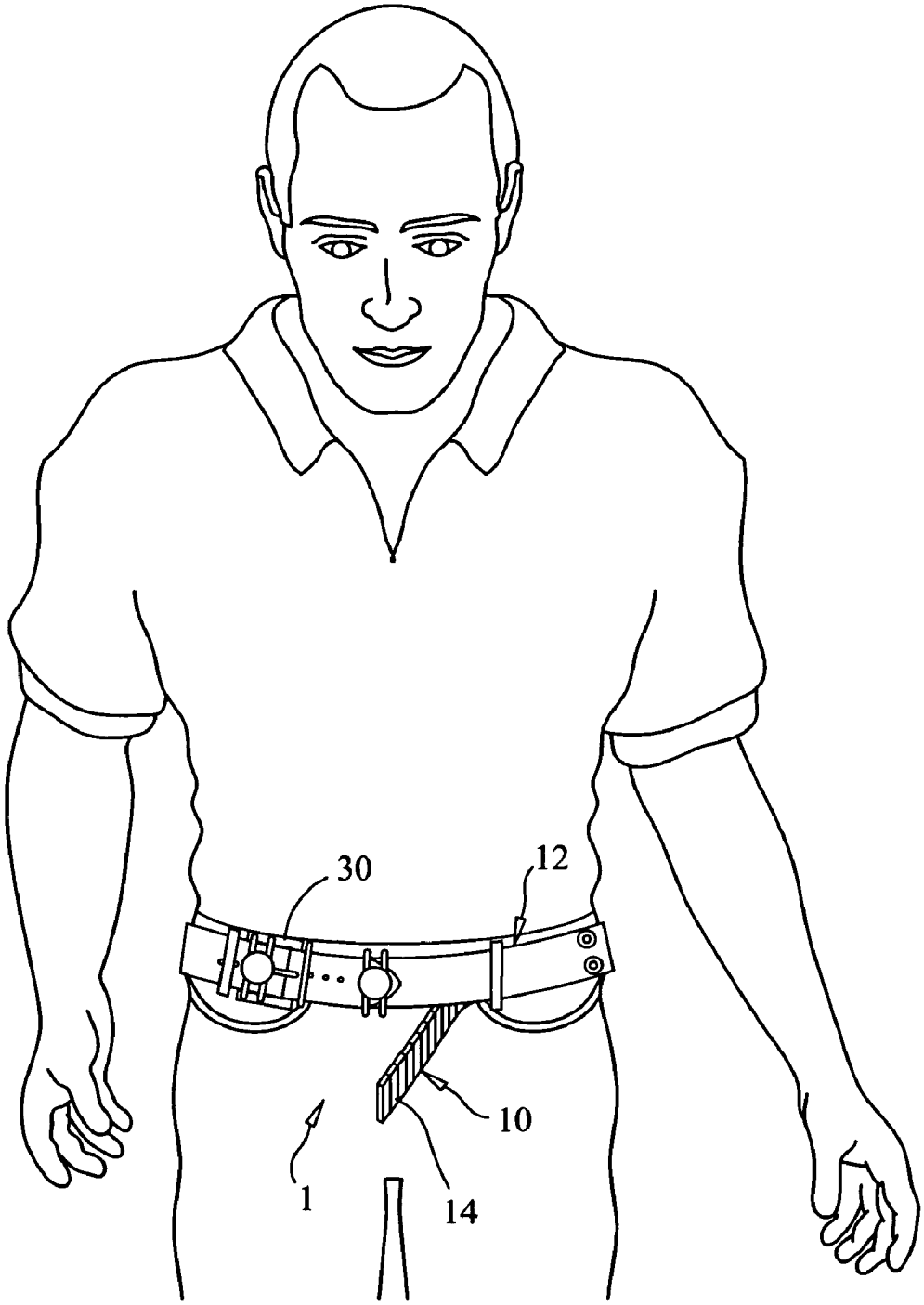
FIG. 11 is a perspective view of a reversed belt sword system worn around a waist of a user and with a handle of a flexible sword ready to be grasped in accordance with the present invention.

With reference now to the drawings, and particularly to FIG. 1, there is shown a perspective view of a belt sword system 1. With reference to FIGS. 2-5, the belt sword system 1 includes a flexible sword 10 and a sword belt 12. The flexible sword 10 is preferably formed from a thin strip of metallic material. The following dimensions are given by way of example and not by way of limitation. The flexible sword 10 has a preferable thickness of between 0.02-0.06 inches and a preferable width of between 0.5-1.25 inches. However, other dimensions may also be used. One end of the flexible sword 10 includes a handle 14 and the other end 16 is preferably angled to form a point 18. However, the other end could also have any other appropriate shape.

The handle 14 may be formed by wrapping tape, thin leather strips or nylon cord around the one end of the flexible sword 10, or the handle 14 may be formed by dipping the one end in a plastic type coating, but other methods of forming the handle may also be used. At least one of the exposed lengthwise edges 20 and the other end 16 may be modified to create a sharp edge or a razor sharp edge. A plurality of graduations 21 and numbers 23 may be formed on the flexible sword 10 to create a measuring device. The flexible sword may be accelerated to a velocity of nearly 100 mph, due to its mass. However, the whip of the Hines et al. '714 patent cannot be accelerated to 100 mph due its flexibility, lack of mass and lack of aerodynamics. Further, the round cross section of the whip cannot be sharpened. At least one lengthwise edge 20 of the flexible sword 10 may be sharpened, such that it may inflict serious injury on an attacker. The prospect of serious injury will act as a deterrent to one or more attackers.

The sword belt 12 preferably includes a belt 22, a plurality of retention clips 24 and a slide buckle keeper 26. The belt 22 includes a strap 28 and a retention buckle 30. One design of slide buckle keeper 26 and retention buckle 30 are shown, but other designs may also be used. Belts are well known in the art and need not be explained in further detail. The strap 28 includes a plurality of prong holes 32 to receive a prong 34 of the buckle 30. The slide buckle keeper 26 retains an end of the strap 28.

The plurality of retention clips 24 are attached along a length of the strap 28 with rivets 36 or the like. Each retention clip 24 includes a substantial U-shaped base 38 with two inward facing flanges 40 extending from each end of the substantial U-shaped base 38. A rivet clearance hole 42 is formed through the substantial U-shaped base 38 to allow insertion of the rivet 36 through each inward facing flange 40. When the exposed lengthwise edges 20 are sharpened, it is preferable to attach each retention clip 24 as close as possible to each other to prevent injury, when wearing the sword belt 12 or when withdrawing the flexible sword 10.

A non-sharpened lengthwise edge 20 would not require as many retention clips 24 to be attached to the strap 28. The sword belt 12 may be worn with the plurality of retention clips 24 facing outward from the waist or facing inward toward the waist. The plurality of retention clips 24 should not be limited to being secured to only an inside or an outside of the sword belt 12, but should include being secured to both an inside and outside of the sword belt 12. Further, more than one flexible sword 10 may be retained in a plurality of retention clips 24 located on an inside or outside of the sword belt 12. The retention clip 24 is preferably fabricated from stainless steel, but other materials may also be used. The stainless steel will not corrode due to humidity or perspiration.

With reference to FIGS. 6-11, the flexible sword 10 is inserted into the plurality of retention clips 24, before the sword belt 12 is inserted into loops 102 of a pair of pants 100. The sword belt 12 is then inserted through the loops 102 in a pair of pants 100 as a normal belt. Once the sword belt 12 is retained in the pair of pants, the one end of the flexible sword 10 is positioned behind an end of the strap 28 and the slide buckle keeper 26. The flexible sword may be withdrawn by sliding the slide buckle keeper 26 away from an end of the handle 14 of the flexible sword 10 and grasping the handle 14 and pulling the flexible sword 10 out of the sword belt 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A belt sword system comprising:

a flexible sword including a handle formed on one end;

a sword belt having a strap and at least one substantially u-shaped retention clip directly attached to an inner surface of said strap along a portion of a length thereof, said at least one substantially u-shaped retention clip being sized to receive a cross section of said flexible sword, at least substantially all of said flexible sword is concealed from view when retained in said at least one substantially u-shaped retention clip; and means for securing said strap to itself around a waist of a user.

2. The belt sword system of claim 1 wherein:

said flexible sword including two lengthwise edges, sharpening at least one of said two lengthwise edges.

3. The belt sword system of claim 1 wherein:

said flexible sword including a point formed on the other end thereof.

4. The belt sword system of claim 1, further comprising:

a buckle being attached to one end of said strap for said means of securing said strap to itself.

5. The belt sword system of claim 1, further comprising:

a slide buckle keeper being retained on said strap and said handle.

6. The belt sword system of claim 1 wherein:

a plurality of graduations and numbers being formed on said flexible sword to create a measuring device.

7. The belt sword system of claim 1 wherein:

forming an angled end on the other end of said flexible sword.

8. A belt sword system comprising:

a flexible sword including a handle formed on one end and two lengthwise edges;

a sword belt having a strap and a plurality of substantially u-shaped retention clips directly attached to an inner surface of said strap along a portion of a length thereof, said plurality of substantially u-shaped retention clips being sized to receive a cross section of said flexible sword, a space is created between adjacent substantially u-shaped retention clips of said plurality of substantially u-shaped retention clips to allow said sword belt to be bent, said plurality of substantially u-shaped retention clips capture both edges of a width of said flexible sword, at least substantially all of said flexible sword is concealed from view when retained in said plurality of substantially u-shaped retention clips; and means for securing said strap to itself around a waist of a user.

9. The belt sword system of claim 8 wherein:

said flexible sword including a point formed on the other end thereof.

10. The belt sword system of claim 8, further comprising:

a buckle being attached to one end of said strap for said means of securing said strap to itself.

11. The belt sword system of claim 8, further comprising:

a slide buckle keeper being retained on said strap and said handle.

12. The belt sword system of claim 8 wherein:

a plurality of graduations and numbers being formed on said flexible sword to create a measuring device.

13. The belt sword system of claim 8 wherein:

forming an angled end on the other end of said flexible sword.

14. A belt sword system comprising:

a flexible sword including a handle formed on one end;

a sword belt having a strap and a plurality of substantially u-shaped retention clips directly attached to an inner surface of said strap along a portion of a length thereof, said plurality of substantially u-shaped retention clips being sized to receive a cross section of said flexible sword, a space is created between adjacent substantially u-shaped retention clips of said plurality of substantially u-shaped retention clips to allow said sword belt to be bent, said plurality of substantially u-shaped retention clips capture both edges of a width of said flexible sword, said flexible sword is concealed from view when retained in said plurality of substantially u-shaped retention clips, wherein said flexible sword is bent around the wearer with the aid of said strap and said plurality of substantially u-shaped retention clips, potential energy is stored in said flexible sword when inserted into said plurality of substantially u-shaped retention clips, said handle is released from said sword belt into a hand of a wearer, the potential energy propels said handle into the hand, which aids in the withdrawal and immediate striking action of said flexible sword from said plurality of substantially u-shaped retention clips; and means for securing said strap to itself around a waist of a user.

15. The belt sword system of claim 14 wherein:

said flexible sword including two lengthwise edges, sharpening at least one of said two lengthwise edges.

16. The belt sword system of claim 14 wherein:

said flexible sword including a point formed on the other end thereof.

17. The belt sword system of claim 14, further comprising:

a buckle being attached to one end of said strap for said means of securing said strap to itself.

18. The belt sword system of claim 14, further comprising:

a slide buckle keeper being retained on said strap and said handle.

19. The belt sword system of claim 14 wherein:

forming an angled end on the other end of said flexible sword.

* * * * *